US005408257A

United States Patent [19]

Hiramatsu et al.

[11] Patent Number: 5,408,257

[45] Date of Patent: Apr. 18, 1995

[54] INK TANK HAVING A PARTITION MEMBER FORMING AN INK FLOW PATH TO AN OUTLET

[75] Inventors: Soichi Hiramatsu; Hideki Yamaguchi, both of Yokohama; Shinya Matsui, Tokyo, all of Japan

[73] Assignee: Canon Kabushiki Kaisha, Tokyo, Japan

[21] Appl. No.: 128,755

[22] Filed: Sep. 30, 1993

Related U.S. Application Data

[63] Continuation of Ser. No. 745,449, Aug. 15, 1991, abandoned.

[30] Foreign Application Priority Data

Aug. 17, 1990 [JP] Japan ..... 2-215928
Aug. 9, 1991 [JP] Japan ..... 3-200277

[51] Int. Cl.[6] ..... B41V 2/19
[52] U.S. Cl. ..... 347/92; 347/85
[58] Field of Search ..... 347/92, 89, 85; 346/140.1

[56] References Cited

U.S. PATENT DOCUMENTS 4,313,124 1/1982 Hara .
4,345,262 8/1982 Shirato et al. .
4,394,669 7/1983 Ozawa ..... 346/140 R
4,456,916 6/1984 Kocot ..... 346/140 R
4,459,600 7/1984 Sato et al. .
4,463,359 7/1984 Ayata et al. .
4,463,362 7/1984 Thomas ..... 346/140 R
4,471,364 9/1984 Kocot ..... 346/140 R
4,539,568 9/1985 Lewis ..... 346/140 R X
4,558,333 12/1985 Sugitani et al. .
4,658,273 4/1987 Yuki ..... 346/140 R
4,723,129 2/1988 Endo et al. ..... 346/1.1
4,740,796 4/1988 Endo et al. .

FOREIGN PATENT DOCUMENTS 0184376 6/1986 European Pat. Off. .
54-48652 4/1979 Japan .
175912 10/1982 Japan .
59-165660 9/1984 Japan .
194854 11/1984 Japan .

*Primary Examiner*—Joseph W. Hartary
*Attorney, Agent, or Firm*—Fitzpatrick, Cella, Harper & Scinto

[57] ABSTRACT

An ink tank for storing ink comprises an ink storage unit, an induction outlet provided in the ink storage unit for delivering to the outside the ink stored in the ink storage unit, and a partition member for partitioning the region where the induction outlet is provided from the rest of the ink tank, the partition being higher than the height at which the induction outlet is provided and having at least a part lower than the liquid level of ink stored in the ink storage unit, thus preventing any inconveniences resulting from the mixture of air and ink by vibration in order to obtain a stable printing condition for an ink jet recording apparatus operated at a high speed.

8 Claims, 6 Drawing Sheets

INK TANK HAVING A PARTITION MEMBER FORMING AN INK FLOW PATH TO AN OUTLET

This application is a continuation of application Ser. No. 07/745,449, filed Aug. 15, 1991, now abandoned.

BACKGROUND OF THE INVENTION

1. Field of the Invention

The present invention relates to an ink tank and an ink jet recording apparatus using the aforesaid ink tank.

2. Related Background Art

An ink jet recording apparatus has an advantage that high-speed recordings can be performed quietly with a low running cost. In recent years, therefore, the ink jet recording apparatus has been in use in many ways as the recording apparatus for a copying machine, facsimile apparatus, and the like, the printer for a word processor, electronic typewriter, and the like, or the image output terminal for a computer and the like.

In an ink jet recording apparatus such as this, there are the so-called serial printer type wherein the recording is performed while the recording head is being scanned in the predetermined direction with respect to the recording medium, and the line printer type using the full multitype recording head in which the discharging ports are aligned to cover the entire region corresponding to the full width of the recording medium. Particularly, the former is such that its recording head itself performs the operation (the reciprocal motion along the platen roller), and a structure such as given below is often employed.

In the ink jet recording apparatus, liquified ink is supplied from an ink supply source to the recording head main body. At this juncture, in the recording head used for the serial printer type recording apparatus, a sub-tank, which is detachably connected to the recording head, is provided as an intermediate reservoir member in the ink supply system for the recording head in such a manner that this sub-tank is allowed to scan together with the recording head. This sub-tank is not filled with ink completely in its inside but is used with a predetermined amount of air reserved therein. Then, with the existence of this air portion, the shock generated by the motion of the ink head at the time of recording or at the time of the head coming to a stop is softened to prevent the ink leakage from the discharging port due to such shock or the ingression of air into the discharging port.

Here, the mode of the sub-tank will be described.

FIG. 9 is a plan view showing an example of the sub-tank arranged in a conventional recording head, and FIG. 10 is a cross-sectional side view thereof. In FIG. 9 and FIG. 10, a reference numeral 117 designates the entire body of the sub-tank; 117*a*, the induction outlet of an ink supply tube for supplying ink to the recording head; 117*b*, the connecting portion of the tube (sub-tank tube) communicated with a suction means for sucking air or ink in the sub-tank 117 therethrough; and 117*c*, an induction port for the ink supply. Also, the dashed line represents the actual liquid level (horizontal plane) to be formed when the sub-tank is installed in the carriage in the main body of the apparatus.

The height, measured from the bottom face of the tank, of the induction outlet 117*a* of the ink supply tube for supplying ink contained in the sub-tank 117 to the head is lower than the connecting portion 177*b* to the sub-tank tube. By actuating the suction means to induce ink into the sub-tank 117 from the induction port 117*c*, it is possible to perform a stable ink supply because the liquid level is usually positioned sufficiently higher than the induction outlet 117*a* of the supply tube to the head. Also, the structure is arranged so that a reservoir of air is always maintained above the connecting portion 117*b* to the sub-tank tube.

Usually, at the time of recording (printing) with the sub-tank 117 being installed in the carriage of the main body of the apparatus, the ink contained in the sub-tank 117 maintains the liquid level represented by the dashed line in FIG. 10. Then, a substantially equal amount of ink to that of the ink consumed by the head is refilled from the ink supply source through the ink inlet 117*c* because the sub-tank 117 is a closed system.

Now, in the serial printer, while the printing is performed by causing the recording head to travel, the ink supply system (the supply tube connecting the ink supply source and the sub-tank, for example) swings at that time, and if no sub-tank is provided, ink in the recording head is compressed or decompressed due to ink in the swinging supply tube. However, if the sub-tank 117 with the air reservoir therein is provided, it is possible to prevent the fluctuation of the pressure exerted on the ink in the recording head by the damper effect thereof; thus making stable printing possible.

Nevertheless, for a modern ink jet recording apparatus, a higher speed printing is required. Accordingly, the motion of the recording head has become increasingly quicker and more intense as a matter of course. Therefore, the motion of the supply tube and the like accompanying the recording head in scanning is more intense, leading to the necessity of a sufficient air reservoir.

In the above-mentioned ink jet recording apparatus under the conventional art, however, there is a problem as described below.

In order to obtaining a sufficient air reservoir, the liquid level in the sub-tank 117 is arranged at a position considerably low in the inner space of the sub-tank 117 while the motion of the recording head is quick and considerably violent. Consequently, when the entire body of the sub-tank 117, which integrally travels to scan, swings violently, ink and air in the sub-tank 117 are allowed to mix.

As a result, there is a possibility that air is carried into the recording head through the supply tube to the head when bubbles generated by such mixture approach the induction outlet 117*a* for carrying ink in the sub-tank 117 to the head.

There is known a structure disclosed in Japanese Utility Model Laid-Open Application 54-48652 (Applied in Japan on Sept. 10, 1977 and Laid-Open on Apr. 4, 1979), i.e., a structure whereby the inside of the ink tank installed in the head carriage is divided into a plurality of tank chambers by partition plates. However, there is still a possibility that bubbles are carried into the recording head once babbles are generated by the vibration.

There is also considered a structure as shown in FIG. 7 and 8 thereby to prevent the mixture of air and ink by vibration with the provision of an inner wall 117*d* in the sub-tank 117. There is still a possibility that air is not sufficiently prevented from reaching the induction outlet 117*a* to the head.

SUMMARY OF THE INVENTION

An object of the present invention is to provide an ink tank capable of maintaining the stable recording and an ink jet recording apparatus using the aforesaid ink tank.

Another object of the present invention is to provide an ink tank capable of maximizing the blocking of air bubbles mixed in ink liquid to be supplied to the recording head when ink is supplied to the recording head, and an ink jet recording apparatus using the aforesaid ink tank.

Still another object of the present invention is to provide an intermediate reservoir member for recording ink so that a stable printing is implemented even when a high-speed scanning of the recording head is attempted, and an ink jet recording apparatus.

A further object of the present invention is to provide an intermediate reservoir member for recording ink which receives ink from the recording ink supply source, and at the same time that the aforesaid ink thus received is supplied to the ink jet recording head, a predetermined height of ink level is established in its closed type intermediate reservoir member, wherein the circumferential portion of the ink induction outlet to the ink jet recording head is provided with an encircling member, the aforesaid encircling member having a portion to induce the reserved ink into its encircled space, and at least a part of its height being higher than that of the ink induction inlet from the aforesaid ink supply source.

Still a further object of the present invention is to provide an ink jet recording apparatus wherein there are provided the aforesaid intermediate ink reservoir, means for conveying the aforesaid member and ink jet recording head, which are installed therein, in the predetermined direction with respect to the recording medium, and a recording control means for driving the aforesaid ink jet recording head to discharge ink in the course of the aforesaid conveyance for the performance of recording onto the aforesaid recording medium.

Still a further object of the present invention is to provide an ink tank having an ink storage unit, an induction outlet provided in the aforesaid ink storage unit for delivering to the outside the ink which is contained in the aforesaid ink storage unit, and a partition member having at least a part which is higher than the height of the location where the aforesaid induction outlet is provided and at least a part which is lower than the ink level in the aforesaid ink storage unit, to separate the region, where the aforesaid induction outlet is provided, from the other region.

Still a further object of the present invention is to provide an ink jet recording apparatus capable of installing the aforesaid ink tank therein.

DETAILED DESCRIPTION OF THE PREFERRED EMBODIMENTS

Hereinafter, in reference to the accompanying drawings, the embodiments suited for the present invention will be described.

Figure 1:
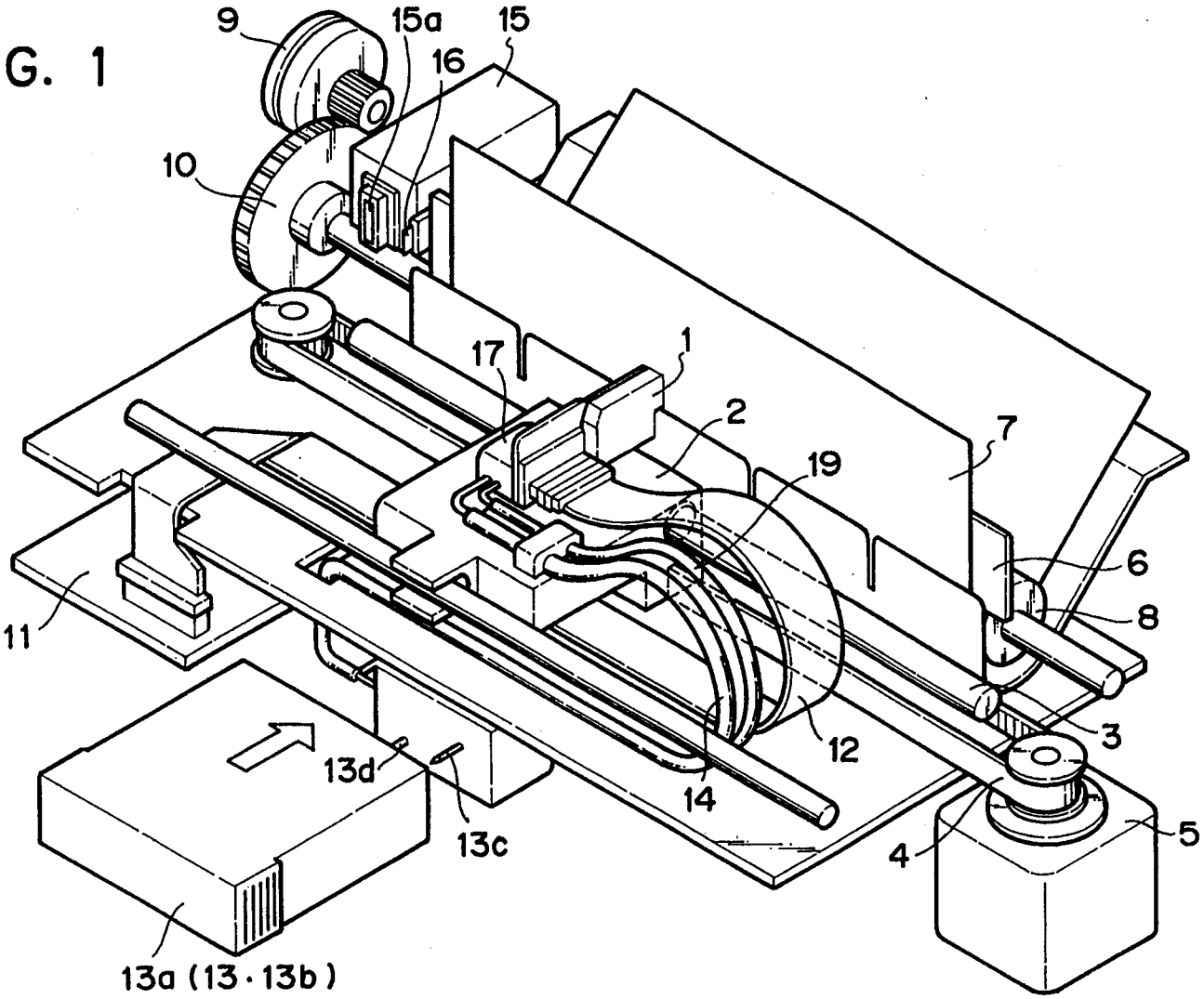
FIG. 1 and FIG. 2 are a perspective view and a schematic side view respectively showing an ink jet recording apparatus according to an embodiment of the present invention.
Figure 2:
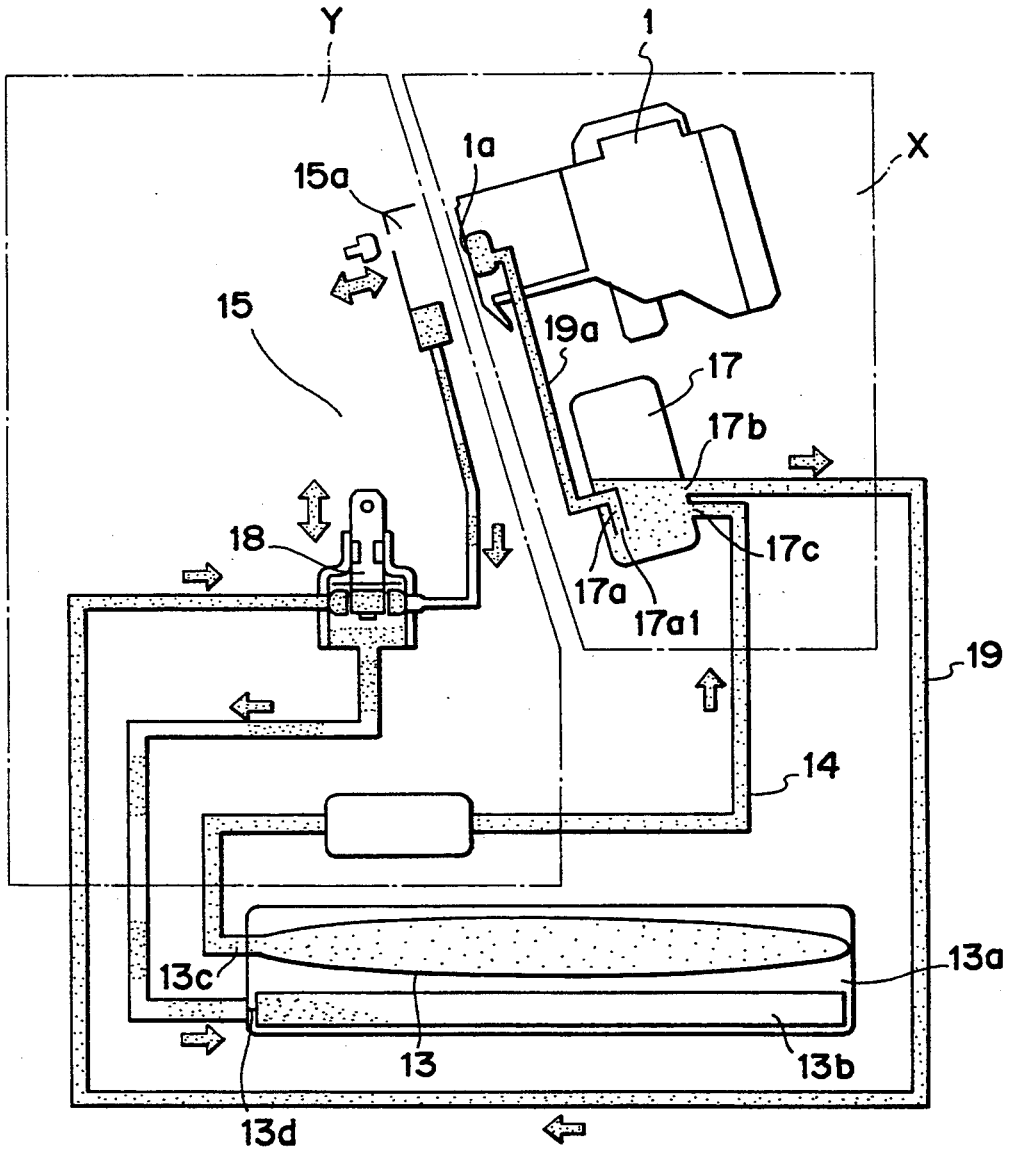

FIG. 1 is a perspective view showing an ink jet recording apparatus according to an embodiment of the present invention. FIG. 2 is a schematic side view thereof.

Reference numeral 1 designates a recording head having an ink discharging port 1*a*, utilizing thermal energy generated by a electrothermal converter which generates heat in response to image information to discharge ink; 2, a carriage with the recording head 1 installed therein, which shuttles along a guide shaft 3; 4, a timing belt connected to the carriage 2 to allow it to travel; and 5, a shift motor for driving the timing belt 4 by predetermined timing. A reference numeral 6 designates a platen for holding a recording medium such as recording sheet 7 at a position facing the ink discharging face of the recording head 1 with a predetermined space to the ink discharging face; 8, a feed roller for feeding the recording sheet 7; and 9, a sheet feeding motor for driving the feed roller 8 through a sheet feeding gear 10. Also, a reference numeral 11 designates a printed circuit board which is connected to the recording head 1 through a flexible cable 12 electrically, and provided with a circuitry to drive the recording head 1 and control the recording apparatus; and 13, a main tank which is the supply source of ink supplied to the recording head 1. In the present embodiment, the recording ink is supplied from the main tank 13 to the recording head 1 through a flexible supply tube 14 which follows the carriage traveling.

In the recording apparatus structured such as this, when the carriage 2 is traveled along the recording sheet 7 by the shift motor 5, ink is discharged from the discharging port 1*a* of the recording head 1 in response to its timing to perform the recording on the recording sheet 7. Also, when the recording for one-line portion is completed, the sheet feed roller 8 is driven by the sheet feeding motor 9 to perform the sheet feeding corresponding to the one-line portion. Also, in the present embodiment, the recording is performed likewise when the carriage 2 is traveled in the opposite direction, i.e., the so-called reciprocal motion recording type.

A reference numeral 15 designates a recovery means arranged outside the recording area for the recording head 1 for recovering the function of the ink discharging, which has a cap 15*a* to cover the ink discharging port; and 16, is a blade arranged in series with the recovery means 15 for cleaning the ink discharging face of the recording head 1. These recovery means 15 and blade 16 are provided to keep the ink discharging in an excellent condition. In this respect, a reference numeral 13*c* designates a supply needle and 13*d*, an ink exhausting needle.

Further, in reference with FIG. 2, the function of the sub-tank 17 will be described. The sub-tank 17 is installed on the carriage 2 and provided between the recording head 1 and the ink supply tube 14 for supplying ink from the main tank 13 to the recording head 1. Then, by a pump 18 in the recovery means 15, air or ink in the sub-tank 17 can be sucked through a sub-tank tube 19. In this respect, the connective communication between the sub-tank 17 and head 1 can be released by removing a tube 19*a*.

Furthermore, the ink which is sucked from the sub-tank 17 is reserved in the exhaust ink reservoir 13*b* in an ink cassette 13*a* through a pump 18. Also, the ink cassette 13*a* has an ink tank 13 and the exhaust ink reservoir 13*b* and is attachable to and detachable from the main body of the apparatus. Further, it is possible to induce any waste ink in the discharging port 1*a* of the recording head 1 also to the exhaust ink reservoir 13*b* by actuating the pump 18 with the cap 15*a* having capped the discharging port 1*a* of the recording head 1.

Also, the height from the tank bottom face of the induction outlet 17*a*1 provided in the sub-tank 17 (ink induction outlet connectively communicated with the record head 1 side) of the supply tube 17*a* for supplying ink to the recording head 1 is defined lower than the connecting portion 17*b* between the tank 17 and sub-tank tube 19. Here, at the outset of installing the sub-tank in the carriage 2, the recovery means 15 (pump 18) is actuated with the discharging port 1*a* being capped to induce ink in the main tank 13 to the sub-tank 17 through the induction port 17*c*. Thus, it is usually possible to position the liquid level sufficiently higher than the induction outlet 17*a* for supplying ink to the recording head 1; hence performing a stable ink supply to the recording head 1. Also, the sub-tank 17 is structured so that the air reservoir is maintained at all times above its connecting portion 17*b* to the sub-tank tube 19.

Usually, the sub-tank 17 keeps the liquid level as shown in FIG. 2. Then, since the sub-tank 17 is a closed system, the ink consumed in the recording head 1 is supplied sequentially from the ink tank 13 to the recording head 1 through the supply tube 14.

As described earlier, the printing on the recording sheet 7 is performed as the carriage 2 travels, but with the air reservoir in the sub-tank 17, the compression or decompression to the ink in the recording head 1 is prevented thereby to make stable printing possible. In this respect, the X region circled by the dashed line in FIG. 2 represents the carriage portion while the Y region represents the main body of the ink jet recording apparatus.

Figure 4:
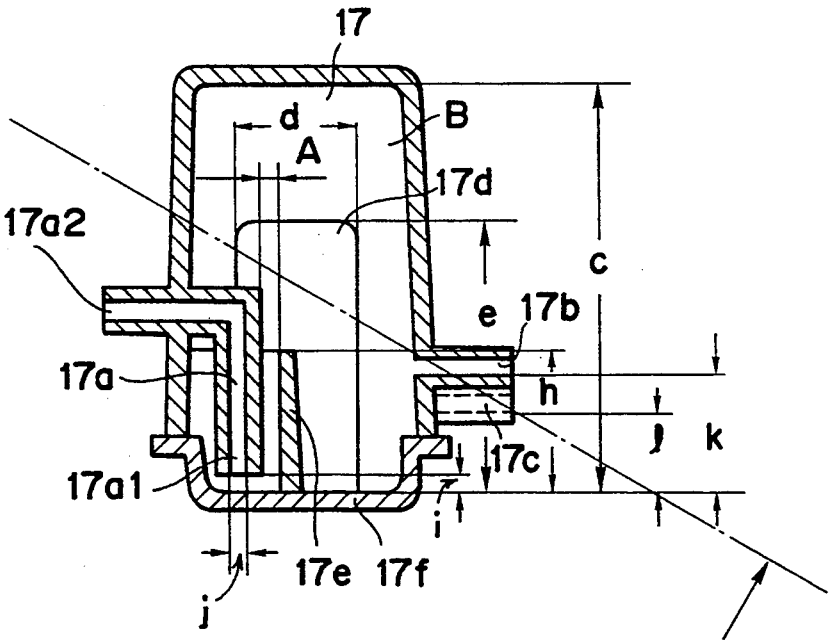

FIG. 4 are a plan view and side cross-sectional view respectively showing the sub-tank 17 according to a first embodiment of the present invention. The sub-tank 17 in the present embodiment is installed on the carriage 2 with an inclination in practice. Therefore, the liquid level is usually in a state as designated by the dashed line.

Figure 7:
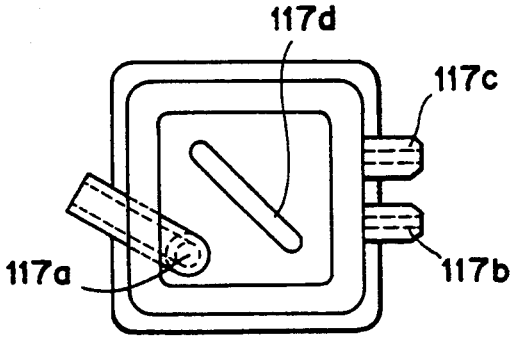
FIG. 7 PRIOR ART
FIG. 7 and FIG. 8 are a plan view and a side cross-sectional view showing another sub-tank.
Figure 8:
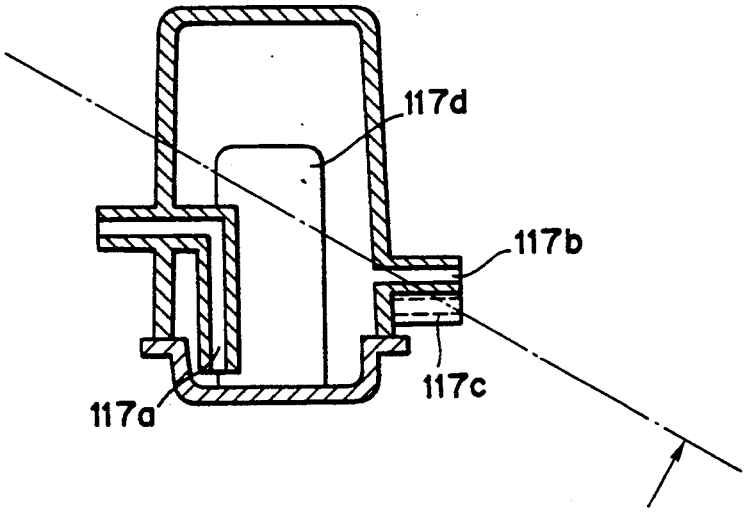
FIG. 8 PRIOR ART
Figure 9:
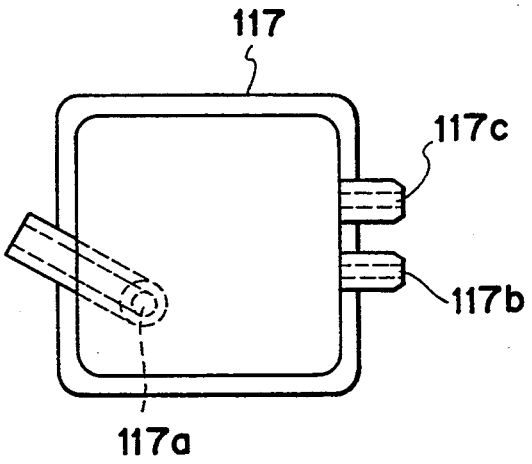
FIG. 9 PRIOR ART
FIG. 9 and FIG. 10 are a plan view and a side cross-sectional view showing a sub-tank according to the conventional example.
Figure 10:
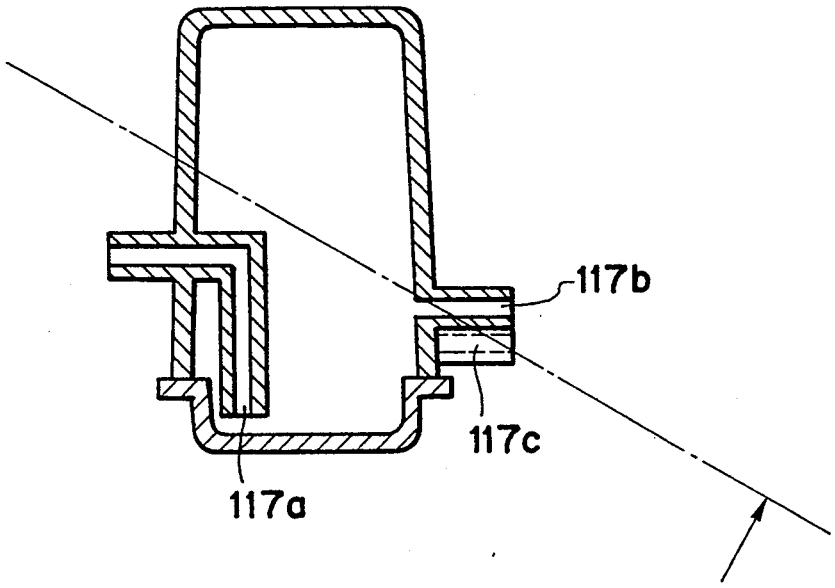
FIG. 10 PRIOR ART

As in the structure shown in FIG. 7 and FIG. 8, there is provided an inner wall portion or member 17*d* in a four-column type ink storage unit B in such a manner that the inner wall is fixed on the bottom face 17*f* thereof in a diagonal direction to prevent ink in the sub-tank 71 from vibrating greatly. Further, in the present embodiment, there is provided an enclosure formed by a partition member 17*e* having two sides 17*e*1 and 17*e*2 rectangular to each other fixed on the bottom face 17*f* to encircle the supply tube 17*a* for supplying ink to the recording head side. In this respect, the partition member 17*e* encircles the supply tube 17*a* with its two sides 17*e*1 and 17*e*2 in cooperation with the side wall of the tank 17. Also, the height from the tank bottom face 17*f* of the walls of the partition member 17*e* is defined sufficiently higher than the outlet 17*a*1 for supplying ink to the head 1, and lower than the height of the usual liquid level. With this arrangement, the aforesaid partition member 17*e* serves to prevent the air ingression into the supply tube 17*a* for supplying ink to the head 1 and to perform the ink supply smoothly. Also, in order to enhance the aforesaid effect, the space A between the supply tube 17*a* and the partition member 17*e* is approximately 1 mm for the narrow place and approximately 2 mm or less for the wide place. Further, the aforesaid effect is more enhanced by making the height of the enclosure 17*e* higher than that of the ink induction inlet 17*c*.

As the above describes, according to the present embodiment, not only the vibration of ink in the sub-tank 17 is restricted as much as possible by the inner wall 17*d* to reduce the mixture of air into ink, but the air mixed with ink is not allowed to approach the induction outlet 17*a*1 by the aforesaid partition member 17*e* to prevent it even if air is mixed into ink. Therefore, it is possible to reduce significantly the probability of air ingression into the recording head 1. In this respect, a reference numeral 17*a*2 designates the inlet to the recording head side.

An example of the size of each part constituting the present embodiment is given below.

Figure 3:
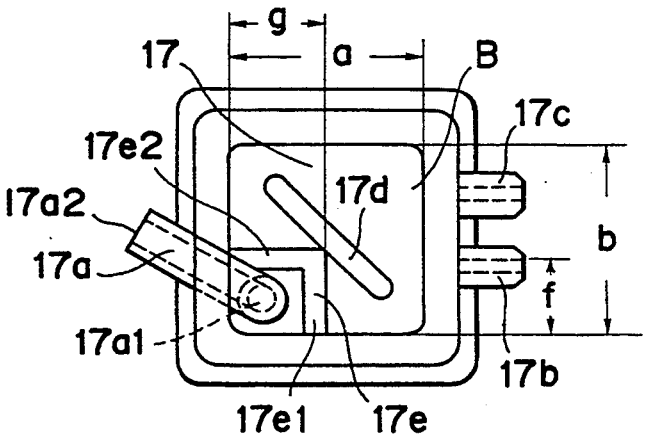
FIG. 3 and FIG. 4 are a plan view and a side cross-sectional view respectively showing a sub-tank according to a first embodiment of the present invention.
Figure 5:
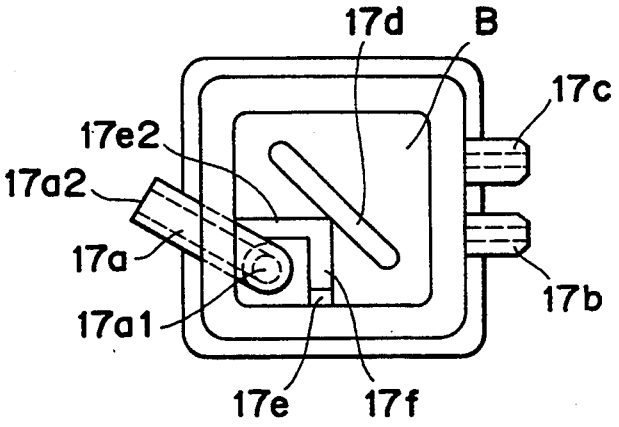
FIG. 5 and FIG. 6 are a plan view and a side cross sectional view respectively showing a sub-tank according to a second embodiment of the present invention.
Figure 6:
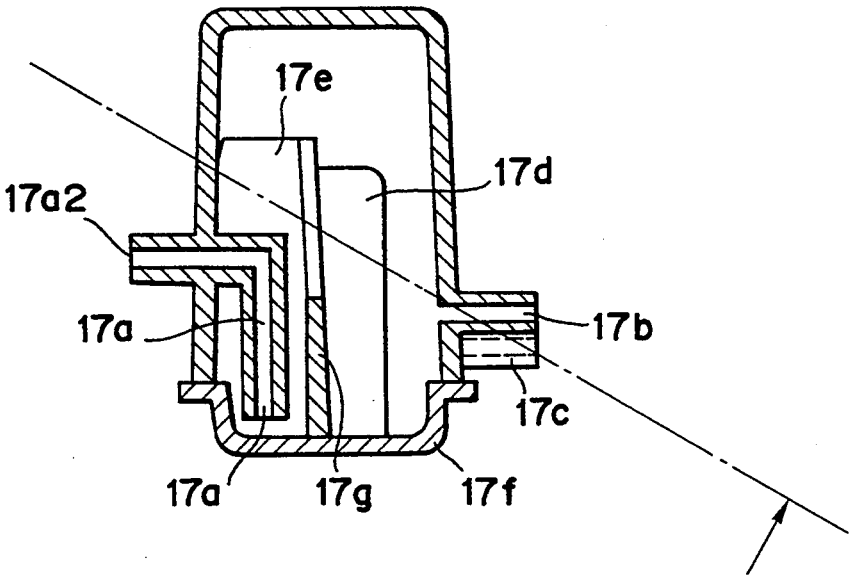

(i) Ink storage unit B
Length (a) approx. 11 mm
Width (b) approx. 11 mm
Height (c) approx. 23 mm
(ii) Inner wall 17*d*
Length (d) approx. 9 mm
Height (e) approx. 15 mm
(iii) Partition member 17*e* (17*e*1 and 17*e*2)
Length 17*e*1 (f) approx. 6 mm
17*e*2 (g) approx. 6 mm
Height (h) approx. 8 mm
(iv) Space (i) between the induction outlet 17*a*1 and bottom plate 17*f*
approx. 1 mm
(v) Tube diameter (j) of supply tube 17*a*
approx. 2 mm
(vi) Height of the connecting portion 17*b* from the bottom plate 17*f* (k)
approx. 7 mm
(vii) Height of the ink induction inlet from the bottom plate 17*f* (l)
approx. 4 mm FIG. 5 and FIG. 6 illustrate a sub-tank according to a second embodiment of the present invention. In the present embodiment, unlike the example shown in FIG. 3 and FIG. 4, a part 17*g* which is lower than the liquid level is provided for the partition member 17*e* while the height of the other part is defined higher than the usual liquid level, thus making it possible to control air and ink more effectively so as not to mix them by vibration and at the same time, to perform the ink supply smoothly. In this respect, it may be possible to provide a hole in the lower part of the enclosure to induce ink into the inside thereof in place of the part having a lower height in the partition member 17*e* as in the second embodiment.

With the structure set forth above, while the ink supply is smoothly maintained, the ingression of air into the supply tube to the recording head side can be effectively prevented despite the violent shaking of the sub-tank.

In this respect, the present invention is not limited to the above-mentioned embodiment, and various modifications thereof will be possible.

For example, while in the above-mentioned embodiment the recording head and the sub-tank are separate bodies, it may be possible to configure these separate bodies into one integrated body. Also, in the above-mentioned embodiment, the ink tank which is the ink supply source is fixed to the apparatus while the ink tank and the sub-tank are connected by the flexible supply tube. However, it may be possible to install the ink tank on the same carriage or on a second carriage which is interlocked with the carriage, on which the recording head or the sub-tank is installed, to travel following such carriage. Also, for the ink tank which is integrally formed with the recording head or sub-tank, if there is a problem such as described earlier in the ink supply system, the present invention can be applied effectively. Furthermore, if only the aforesaid partition member 17*e* has at least a part which is higher than the height at which the aforesaid induction outlet 17*a*1 is provided, it is possible to obtain the intended effect.

According to the aforesaid embodiment, in the intermediate reservoir member (sub-tank) installed on the carriage with the recording head, there is provided the above-mentioned enclosing member such as walls encircling the four sides in the vicinity of the supply tube for supplying ink to the recording head, having at least a part which is lower than the usual liquid level and at least a part which is higher than the induction outlet of the supply tube thereby preventing air ingression into the supply tube. Hence, it is possible to prevent air from being supplied to the recording head and materialize a stable printing condition despite the high speed at which the printing is performed.

Others

In this respect, the present invention is effective for the ink jet recording systems. Particularly, this invention produces an excellent effect on the recording head and recording apparatus of the ink jet system wherein the recording is performed by forming flying droplets utilizing thermal energy. This is because of the fact that with a system such as this a higher density and finer precision of the recording is implemented.

For the typical structure and principle thereof, it is desirable to adopt for its implementation the fundamental principle disclosed, for example, in the specifications of U.S. Pat. No. 4,723,129 and U.S. Pat. No. 4,740,796. This system is applicable to either a so-called on demand type or continuance type. Particularly, in the case of the on demand type, at least one driving signal, which gives a recording liquid a rapid temperature rise exceeding the nucleate boiling, is applied in response to the recording information to the electrothermal converter arranged with respect to a sheet or liquid path holding a recording liquid (ink), thereby causing the electrothermal converter to generate thermal energy. Hence, film boiling is generated on the thermoactive plane of the recording head, resulting in the formation of a bubble in the recording liquid (ink), one to one in response to this driving signal efficiently. The recording liquid (ink) is discharged into the atmosphere through the discharging port by the active force generated in the course of the growth and contraction of this bubble to form at least one droplet. It is more desirable to produce this driving signal in the form of pulses. Then, the growth and contraction of the bubble is appropriately performed instantaneously to implement the discharging of recording liquid (ink) having particularly excellent responsivity. For this pulse type driving signal, the one such as disclosed in the specifications of U.S. Pat. No. 4,463,359 and U.S. Pat. No. 4,345,262 is suitable. In this respect, if the condition disclosed in the specification of U.S. Pat. No. 4,313,124 concerning the invention as regards the temperature rise on the above-mentioned thermoactive plane, it is possible to perform better recordings.

As to the structure of the recording head, the present invention includes a combination of the discharging port, liquid path, electrothermal converter (linear liquid path or rectangular liquid path) such as disclosed in each of the above-mentioned specifications as well as the structure having the thermoactive portion arranged in the bending region using the configuration disclosed in the specifications of U.S. Pat. No. 4,558,333 and U.S. Pat. No. 4,459,600.

In addition, in the serial type recording apparatus as exemplified above, the present invention is effective in the case of using a recording head fixed to the main body of the apparatus, or a freely replaceable chip type recording head for which the electrical connection to the main body of the apparatus and ink supply become possible when it is installed therein, or a cartridge type recording head having the ink tank integrally provided for the recording head itself.

Also, as to the kind of recording head installed or the numbers thereof, it may be possible to install a plurality of recording heads with respect to the different kinds of ink having different recording colors and densities besides the one having only one recording head for a monochrome ink. In other words, the present invention is extremely effective not only to the recording mode having one main color such as black but also to the apparatus provided for at least one of the compound colors formed by various colors or full colors produced by mixing colors irrespective of whether the recording head is constructed integrally as one body or by a combination of plural heads.

Furthermore, as to the mode of the ink jet recorder according to the present invention, there may be various modes including the image output terminals for information processing apparatuses such as computers, those used for copying machines in combination with readers, and for facsimile apparatuses having transmitter and receiver, and the like.

According to the present embodiment set forth above, in the intermediate reservoir member (sub-tank) installed on the carriage with the recording head, there is provided the above-mentioned enclosing member such as walls encircling the four sides in the vicinity of the supply tube for supplying ink to the recording head, having at least a part which is lower than the usual liquid level and of at least a part which is higher than the induction outlet of the supply tube. Thus, it is possible to prevent any incoveniences resulting from the mixture of air and ink by vibration as well as to implement an ink jet recording apparatus thereby obtaining a stable printing condition at a high-speed printing without any significant increase in its manufacturing cost and installation space.

As the above describes, the present invention makes it possible to provide an ink tank thereby maintaining stable recordings and a ink jet recording apparatus using the aforesaid ink tank.

What is claimed is:

1. An ink tank comprising:

an ink storage unit for storing ink at a predetermined liquid level;

an ink supply tube in said storage unit, wherein said supply tube has an outside wall extending downwardly in said storage unit and terminates in an outlet for delivering the ink in said storage unit through said supply tube to a recording head for performing recording;

an inlet in said storage unit for introducing thereto ink from an ink source to maintain the ink in said storage unit at the predetermined liquid level during recording; and a partition member forming an enclosure around said supply tube with a wall higher than said outlet and proximate to said outside wall of said supply tube, at least a part of said partition member being lower than the predetermined liquid level, wherein the sole ink flow path to said outlet during recording is from above said partition member and between said wall of said enclosure and said outside wall of said supply tube.

2. An ink tank according to claim 1, further comprising an inner wall member higher than said partition member and disposed along a diagonal direction in said ink storage unit.

3. An ink tank according to claim 1, wherein said ink tank is integral with the recording head.

4. An ink tank according to claim 1, wherein said ink tank is installed in a carriage capable of shuttling along a platen of a recording apparatus.

5. An ink jet recording apparatus capable of receiving an ink tank and using a recording head for performing recording on a recording medium, said apparatus comprising:

a carriage capable of receiving said ink tank and shuttling in a direction intersecting a conveying direction of the recording medium, said ink tank having an ink storage unit for storing ink at a predetermined liquid level, an ink supply tube in said storage unit, wherein said supply tube has an outside wall extending downwardly in said storage unit and terminates at an outlet for delivering the ink in said storage unit through said supply tube to said recording head for use in recording, an inlet in said storage unit for introducing thereto ink from an ink source to maintain the ink in said storage unit at the predetermined liquid level during recording, and a partition member forming an enclosure around said supply tube with a wall higher than said outlet and proximate to said outside wall of said supply tube, at least a part of said partition member being lower than the predetermined liquid level, wherein the sole ink flow path to said outlet during recording is from above said partition member and between said wall of said enclosure and said outside wall of said supply tube; and conveying means for conveying the recording medium.

6. An ink jet recording apparatus according to claim 5, wherein said recording head performs recording by discharging the ink from a discharging port utilizing thermal energy.

7. An ink jet recording apparatus according to claim 5, further comprising recording control means for driving said recording head to discharge ink for performing recording on the recording medium as said carriage conveys said recording head with respect to the recording medium.

8. An ink jet recording apparatus according to claim 7, wherein said recording head has an electrothermal converter for generating thermal energy to cause film boiling for ink discharging.

* * * * *